US007219820B2

(12) United States Patent
Prozumenshchikov

(10) Patent No.: US 7,219,820 B2
(45) Date of Patent: May 22, 2007

(54) CLOSURE

(75) Inventor: Andrey B. Prozumenshchikov, Moscow (RU)

(73) Assignee: Gletcher Investment Ltd., Moscow (RU)

( * ) Notice: Subject to any disclaimer, the term of this patent is extended or adjusted under 35 U.S.C. 154(b) by 0 days.

(21) Appl. No.: 11/334,455

(22) Filed: Jan. 19, 2006

(65) Prior Publication Data

US 2006/0289569 A1 Dec. 28, 2006

(30) Foreign Application Priority Data

Jun. 14, 2005 (RU) ..... 2005118066

(51) Int. Cl.
*B65D 47/00* (2006.01)

(52) U.S. Cl. ..... 222/547; 215/21

(58) Field of Classification Search ..... 222/547, 222/147, 153.01, 153.02, 153.06, 153.1, 222/566, 567, 570; 215/21, 28, 215, 354, 215/355

See application file for complete search history.

(56) References Cited

U.S. PATENT DOCUMENTS 3,933,284 A * 1/1976 Guala ..... 222/500
5,743,437 A * 4/1998 Moore et al. ..... 222/147
6,854,612 B2 * 2/2005 Thomson ..... 215/21
6,908,013 B2 * 6/2005 Thomson et al. ..... 222/153.06

FOREIGN PATENT DOCUMENTS

EP 1238919 * 9/2002 ..... 222/153.06
WO WO 96/23704 * 8/1996 ..... 215/21
WO WO 98/04474 * 2/1998 ..... 215/21

* cited by examiner

*Primary Examiner*—Lien M. Ngo
(74) *Attorney, Agent, or Firm*—McDermott Will & Emery LLP

(57) ABSTRACT

A closure comprises a body with teeth on its internal surface, a pouring sleeve with a skirt and a liquid stream splitter with longitudinal ribs on its internal side surface, a male thread and fixing teeth that interact with the teeth of the body, windows in the walls of the skirt with transverse protrusions directed inside the pouring sleeve, a lock in the form of hollow cylinder with annular sealing lips on its external surface, said cylinder connected to a larger diameter hollow cylinder by means of a bridge having an external annular flange for fixing in the pouring sleeve, a valve and a cap installed on the pouring sleeve by a thread joint. The cap consists of an internal hood with female thread, a locking ring and an external hood with interlocks in the form of longitudinal splines.

10 Claims, 6 Drawing Sheets

CLOSURE

Figure 1:
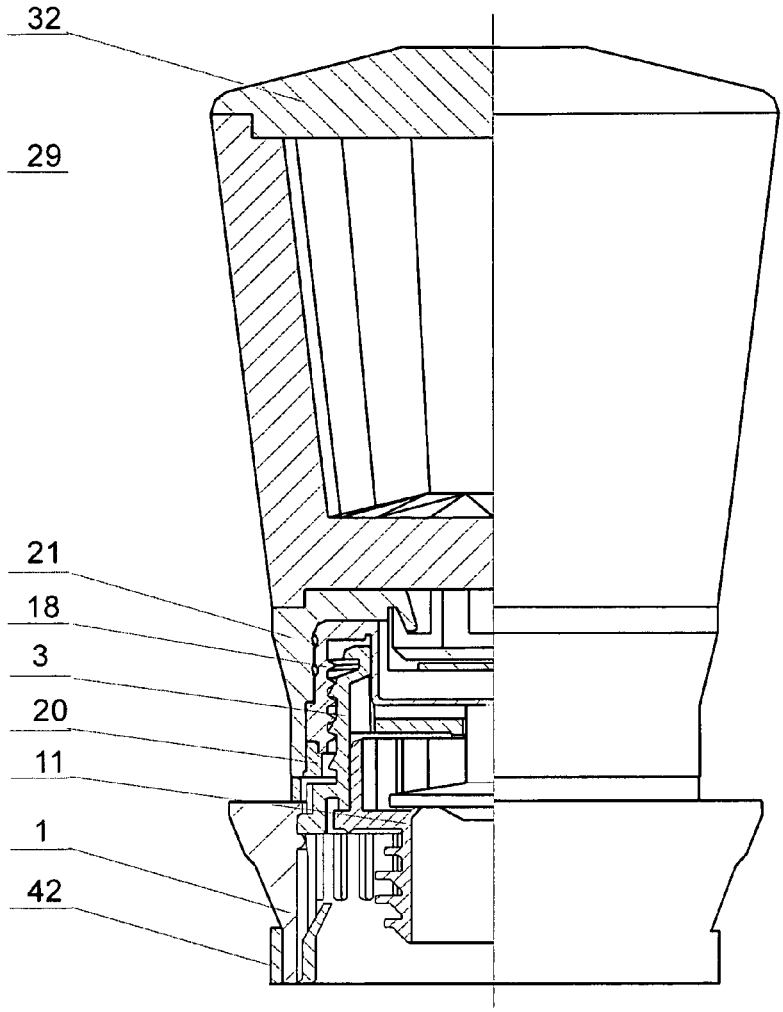

This invention relates to closures for glass bottles, in particular, versatile closures for bottling and storing of alcoholic beverages in such bottles.

Known is a safety lock for bottles and similar containers comprising a cylindrical sleeve with teeth on its internal surface on the side of its outlet end, a pouring member with male thread and fixing teeth that interact with the teeth of the cylindrical sleeve, a cap comprising an inner hood with female thread, a locking ring and an external hood with an interlock in the form of suitable longitudinal ribs, said cap being installed on the pouring member, and a removable lock with a one-way valve. The pouring member has a skirt, which has windows at its outlet end spaced equally over its circumference with transverse inward protrusions, under which longitudinal protrusions are located. The removable lock is a hollow cylinder with annular sealing lips on its external surface; said cylinder is connected to a larger diameter hollow cylinder by means of a bridge fitted with an external annular collar for fixing the bridge on the pouring member; the larger diameter hollow cylinder accommodates a valve; there are equally spaced circumferential longitudinal stiffening ribs on the internal surface and annular sealing lips on the external surface of said cylinder (RU No. 42034, U 1, 2003).

A drawback to the known safety lock for bottles is inadequate sealing reliability due to possible leaks or evaporation of the liquid during transportation, handling or storage, through gaps between the skirt of the pouring sleeve and the body because there are no interlocks above the windows in the skirt.

A technical result of the invention is increased bottle sealing reliability.

The technical result is on account of design of the closure, which has a body with teeth on its internal surface, a pouring sleeve with a skirt and a liquid stream splitter with longitudinal ribs on its internal side surface, a male thread and fixing teeth that interact with the teeth of the body, windows in the walls of the skirt with transverse protrusions directed inside the pouring sleeve, a lock in the form of hollow cylinder with annular sealing lips on its external surface, said cylinder connected to a larger diameter hollow cylinder by means of a bridge having an external annular flange for fixing in the pouring sleeve, a valve and a cap installed on the pouring sleeve by means of a thread joint. The cap consists of an internal hood with female thread, a locking ring and an external hood with interlocks in the form of longitudinal splines.

The body and the skirt of the pouring sleeve have retaining annular protrusions located on the internal surface of the body and the external surface of the skirt above the windows; the inner hood has a recess on its end face and the external hood has a multifaceted hollow protrusion on the internal surface of its top face matching the said recess; the external hood has a barrel-shaped extra hood; there is a multifaceted protrusion on its external bottom surface, which is congruent with the multifaceted protrusion on the external hood and interacts with it.

The liquid stream splitter is a disc with a central hole and circumferential ports that are formed by bridges connecting the disc and the pouring sleeve.

The valve is a disc with a rod located in its center coaxially and able to close the central hole of the stream splitter.

There is a recess on the external surface of the barrel bottom; said recess mates the protrusion on the top face of the external hood. The larger diameter hollow cylinder of the lock has annular sealing lips on its external surface and longitudinal stiffening ribs spaced equally on its internal surface. The valve rod has a through hole. The barrel is shaped as a cylinder or a truncated cone, or a truncated multifaceted pyramid and its top is covered with a protective cap, which has a protrusion interacting with the internal surface of the barrel. The body has a decorative shell made of metal foil and shaped as an annular ribbon.

Providing the body and the skirt with retainers in the form of annular protrusions located on the internal surface of the body and the external surface of the skirt above the windows, respectively, prevents their longitudinal moving relative to each other and improves the bottle closing due to a tighter fit.

The presence of a recess on the inner hood and a multifaceted hollow protrusion on the external hood and the provision of the external hood with an extra hood in the form of a barrel with a multifaceted protrusion on the external surface of its bottom provides their reliable engagement, makes the screwing of the cap easier, thus improving the closure reliability.

The stream splitter having the form of a disc with a central hole and circumferential ports and the valve having the form of a disc with a rod to close the central hole in the stream splitter improve the closure reliability, since, while screwing the cap, the face of recess in the inner hood abuts against the valve rod thus pressing its disc to the lock tightly.

The presence of a recess in the barrel bottom and a protrusion on the top face of the external hood and the provision of the larger diameter hollow cylinder with annular sealing lips and longitudinal stiffening ribs provides a reliable fixing of the barrel to the external hood and of the lock to the pouring sleeve.

The through hole in the valve rod ensures air inflow and prevents a pressure decrease in the bottle when liquid flows out, thus accelerating the pouring.

The presence of a protective cap with a protrusion rules out contamination of the internal barrel surface and makes it possible to use the barrel as a measuring glass; and the provision of the body with a decorative shell shaped as a annular ribbon made of metal foil improves the outward appearance of the apparatus and allows indication of additional information on the ribbon.

Figure 2:
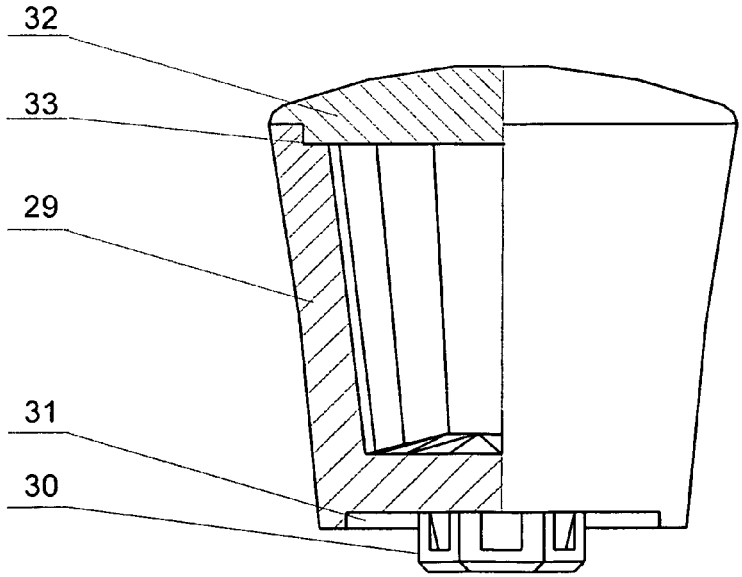
Figure 3:
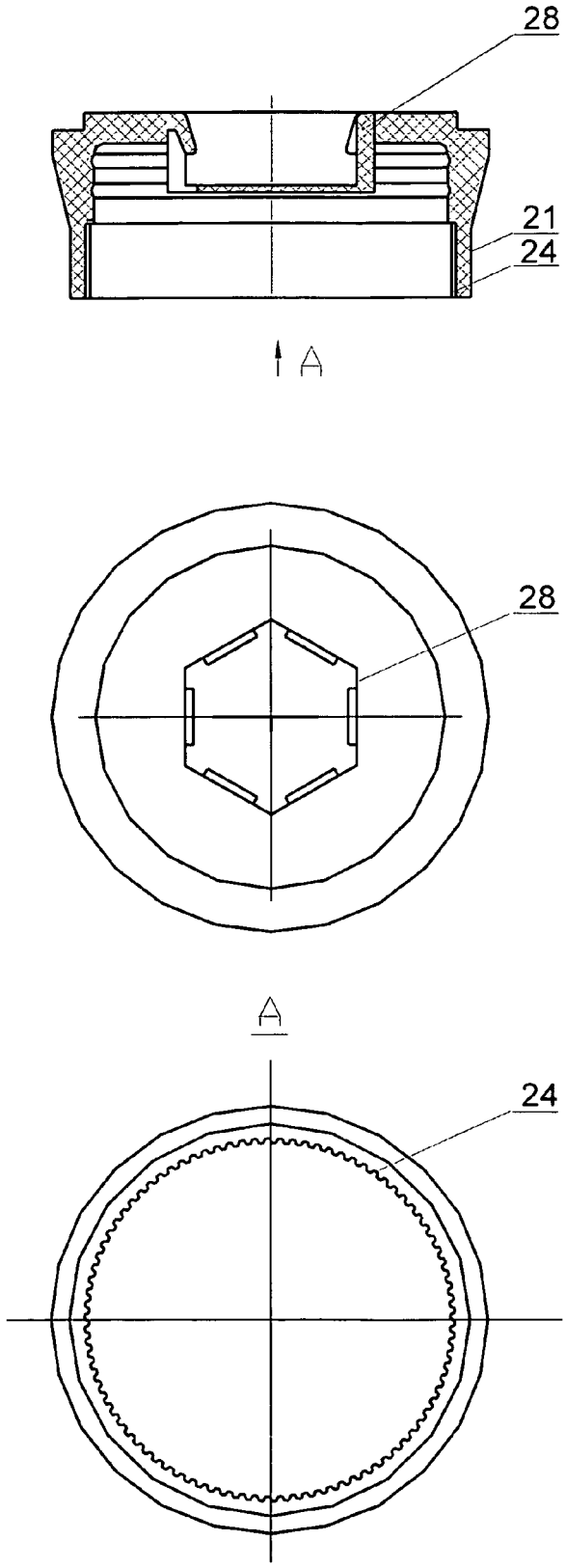
Figure 4:
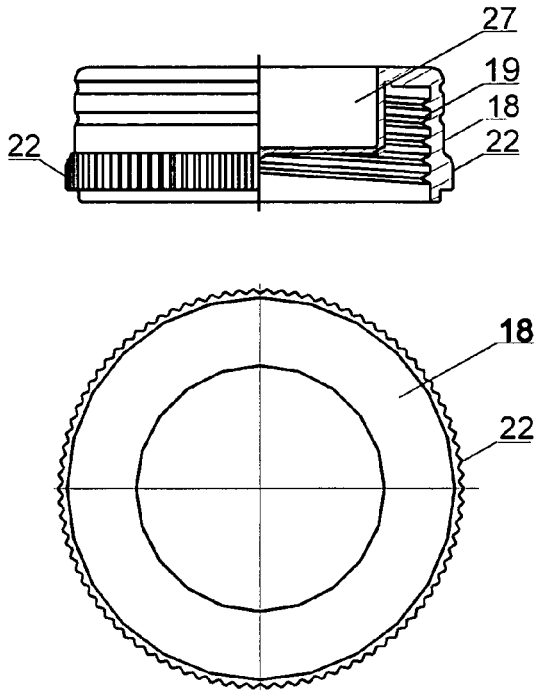
Figure 5:
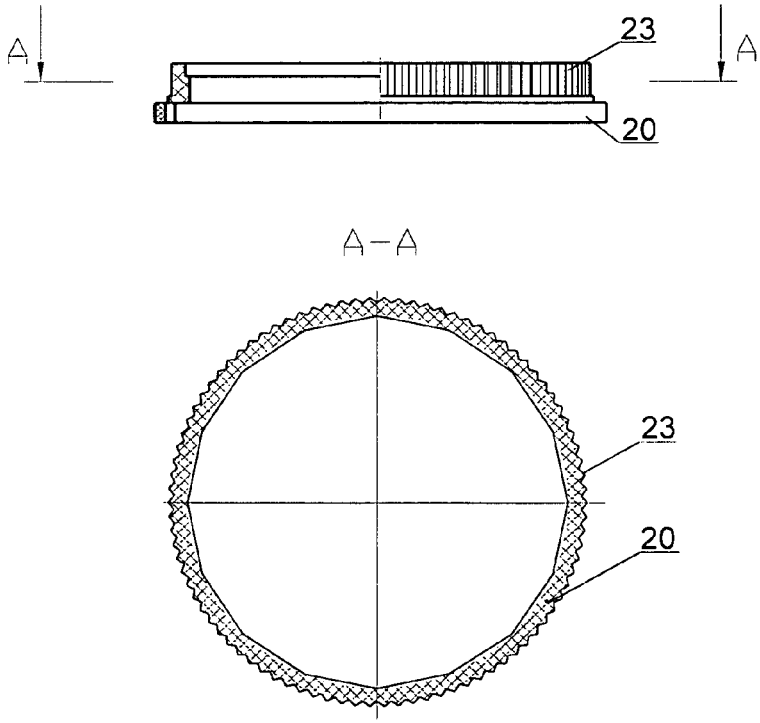
Figure 6:
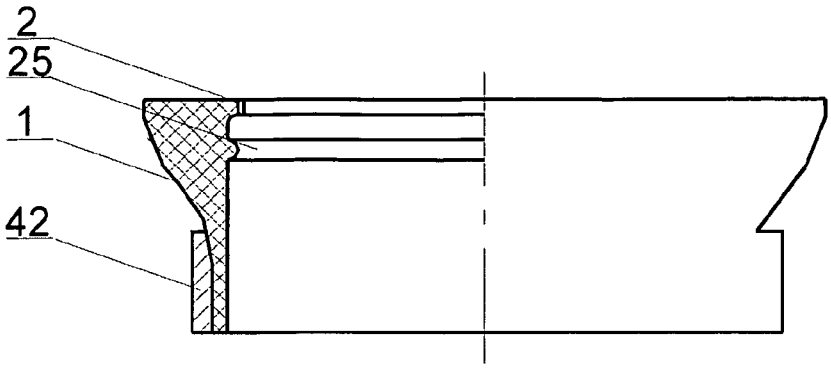
Figure 6:
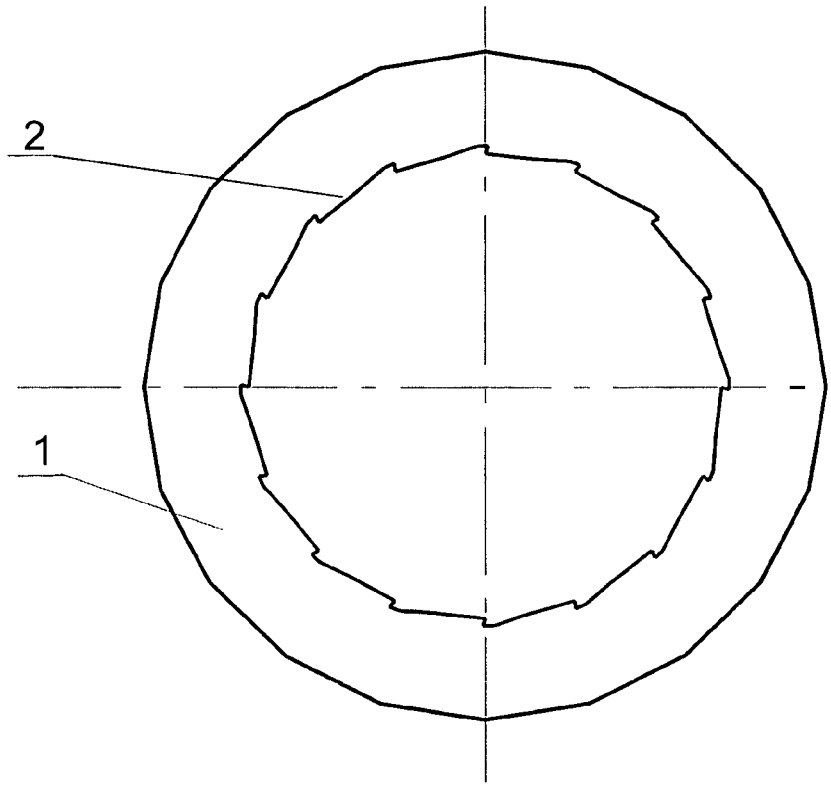
Figure 7:
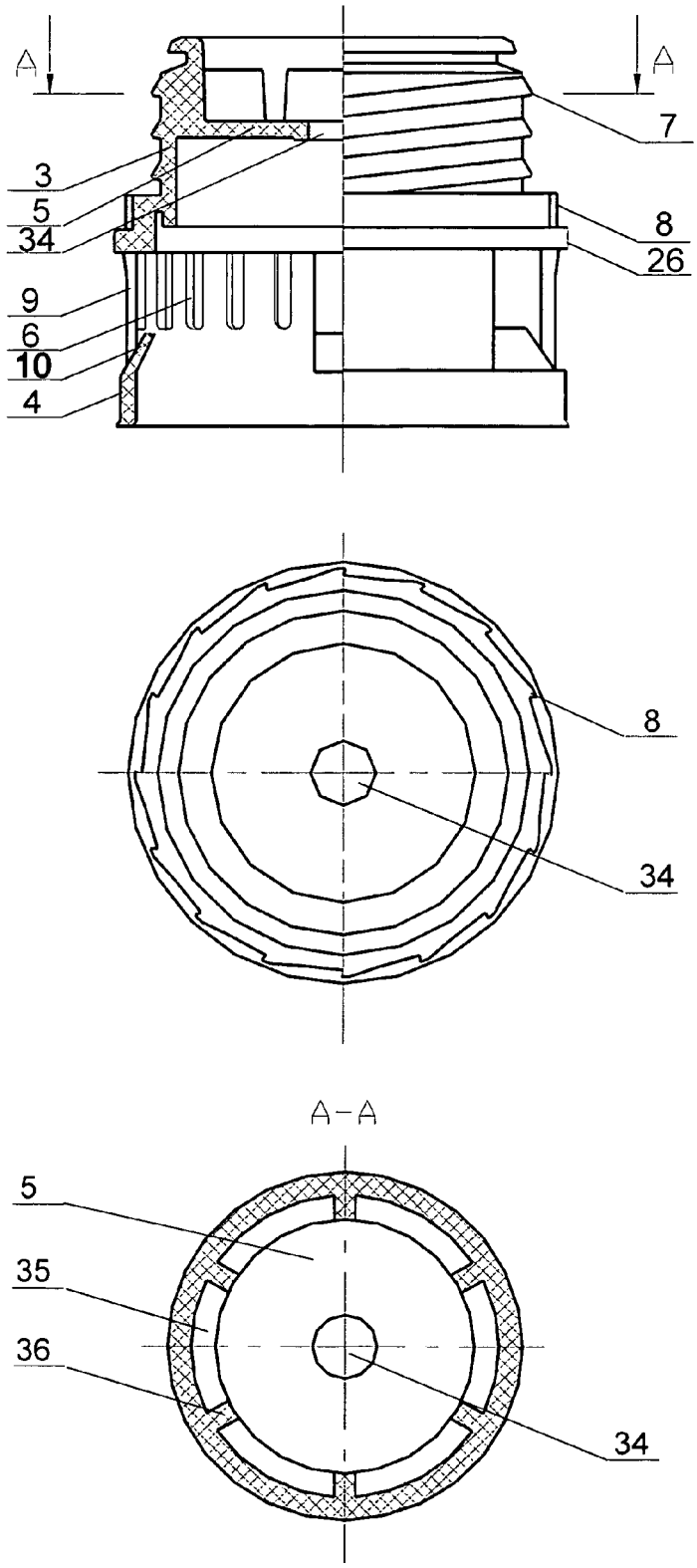
Figure 8:
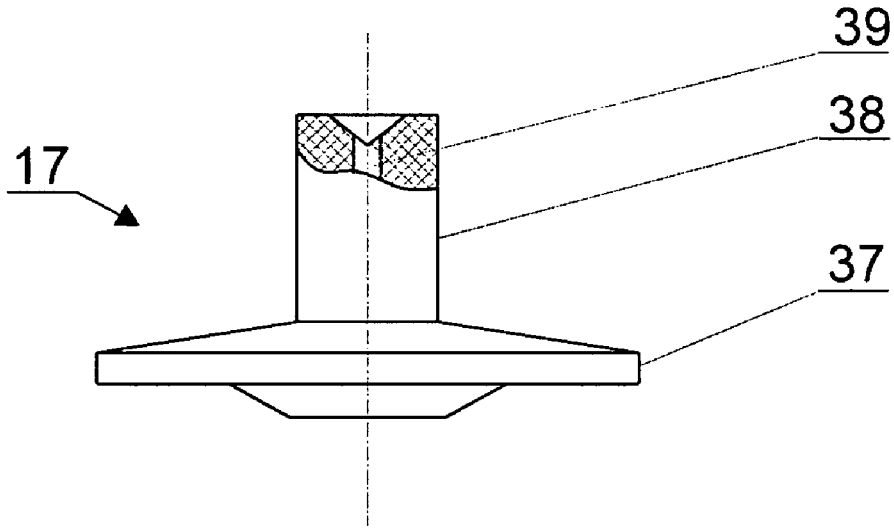
Figure 9:
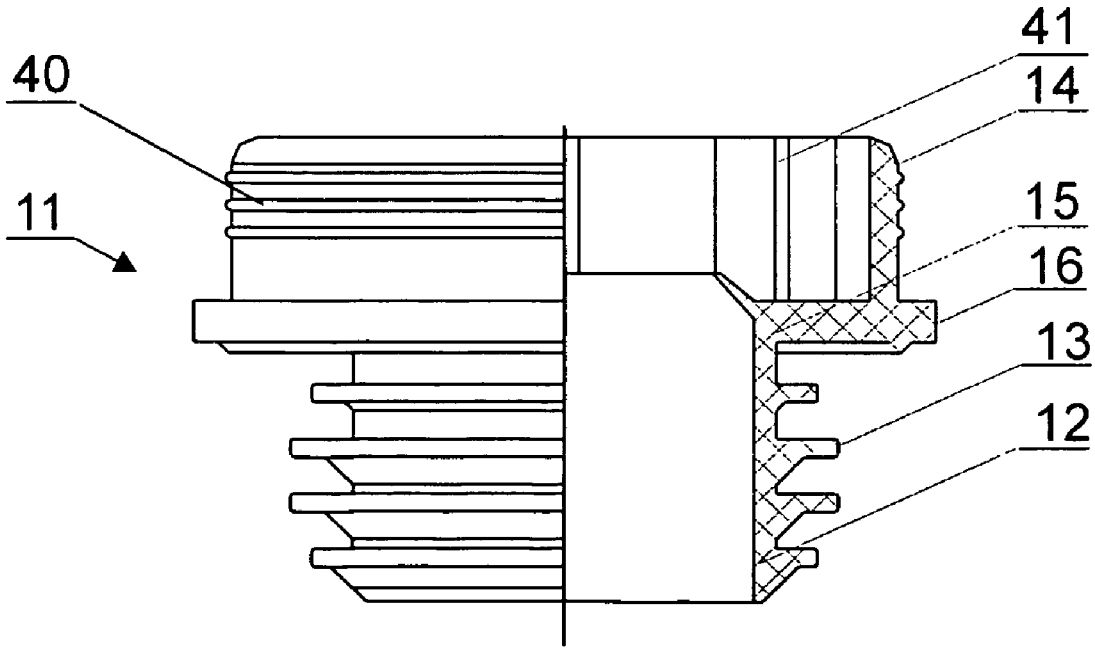

The essence of the invention is shown on the following drawings:

FIG. 1 shows the general view of the apparatus;
FIG. 2 shows the view of the extra hood;
FIG. 3 shows the view of the external hood;
FIG. 4 shows the view of the inner hood;
FIG. 5 shows the view of the locking ring;
FIG. 6 shows the view of the body;
FIG. 7 shows the view of pouring sleeve;
FIG. 8 shows the view of the valve; and
FIG. 9 shows the view of the lock.

The closure comprises the body 1 with teeth 2, the pouring sleeve 3 with a skirt 4, the liquid stream splitter having the form of a disc 5, longitudinal ribs 6, a thread 7, fixing teeth 8, windows 9, transverse protrusions 10, the lock 11 having the form of a hollow cylinder 12 with annular sealing lips 13, said hollow cylinder connected to a larger diameter hollow cylinder by a bridge 15 fitted with external annular flange 16, the valve 17 and a cap consisting of inner hood 18 with thread 19, locking ring 20 and external hood 21 interlocked by longitudinal splines 22, 23 and 24, respectively. The body 1 and the skirt 4 of the pouring sleeve have retaining annular protrusions 25 and 26, the inner hood 18 has a recess 27 on its end face and the external hood 21 has a multifaceted hollow protrusion 28; furthermore, the external hood has an extra hood having the form of a barrel 29 with a multifaceted protrusion 30, a recess 31 and a protective cap 32 with a protrusion 33. The disc 5 has a central hole 34, circumferential ports 35 and bridges 36. The valve 17 consists of a disc 37 and a rod 38 with a hole 39. The hollow cylinder 14 of the lock 11 has annular sealing lips 40 and longitudinal stiffening ribs 41. The body 1 has a decorative shell made of metal foil shaped as an annular ribbon 42.

The closure will be assembled as follows:

The lock 11 with the valve 17 shall be inserted into the pouring sleeve 3. This assembly shall be inserted from below into the body 1 until it rests and, the retaining annular protrusions 25 and 26 interlock with each other. The inner hood 18 and the locking ring 20 shall be then inserted from below into the external hood 21 up to the stop at the rear and this cap shall be screwed with an effort onto the pouring sleeve 3. Having done this, an extra hood 29 having the form of a barrel shall be installed from above onto the external hood 21. The multifaceted protrusion 30 of that extra hood fits tightly in the recess 27 of the external hood.

The assembled closure shall be forced onto the bottle neck (not shown in the Fig.). While this is being done, the transverse protrusions 10 and longitudinal ribs 6 arranged on the internal surface of the skirt 4 and the annular sealing lips 13 of the pouring sleeve 3 provide a tight fit of the closure on the bottle neck.

The invention claimed is:

1. A closure comprising a body with teeth on its internal surface, a pouring sleeve with a skirt and a liquid stream splitter with longitudinal ribs on the internal side surface, a male thread and fixing teeth that interact with the teeth of the body, windows in the walls of the skirt with transverse protrusions directed inside the pouring sleeve, a lock in the form of a hollow cylinder with annular sealing lips on its external surface, said cylinder connected to a larger diameter hollow cylinder by means of a bridge having an external annular flange for fixing in the pouring sleeve, a valve and a cap installed on the pouring sleeve by means of a thread joint with the cap consisting of an internal hood with female thread, a locking ring and an external hood with interlocks in the form of longitudinal splines, wherein the body and the skirt of the pouring sleeve have retaining annular protrusions located on the internal surface of the body and the external surface of the skirt above the windows; the inner hood has a recess on its end face and the external hood has a multifaceted hollow protrusion on the internal surface of the top face installed in said recess; the external hood has a barrel-shaped extra hood; there is a multifaceted protrusion on its external bottom surface, which is congruent and interacting with the multifaceted protrusion on the external hood, said protrusion directed towards the bottom end of the external hood.

2. The closure as claim 1, wherein the liquid stream splitter is a disc with a central hole and circumferential ports formed by bridges connecting the disc and the pouring sleeve.

3. The closure as claim 1, wherein the valve is a disc with a rod located in its center coaxially and able to close the central hole in the stream splitter disc.

4. The closure as claim 1, wherein there is a recess on the external surface of the barrel bottom, which is congruent and interacting with the protrusion on the top face of the external hood.

5. The closure as claim 1, wherein the larger diameter hollow cylinder of the lock has annular sealing lips on its external surface and longitudinal stiffening ribs equally spaced on its internal surface.

6. The closure as claim 3, wherein the valve rod has a through hole.

7. The closure as claim 1, wherein the barrel is shaped as a cylinder or a truncated cone, or a truncated multifaceted pyramid.

8. The closure as claim 1, wherein the barrel is closed with a protective cap having a protrusion that interacts with the internal surface of the barrel.

9. The closure as claim 1, wherein the body has a decorative shell.

10. The closure as claim 9, wherein the decorative shell is made of metal foil shaped as an annular ribbon.

* * * * *